US008632375B1

(12) United States Patent
Mertes

(10) Patent No.: US 8,632,375 B1
(45) Date of Patent: Jan. 21, 2014

(54) TOY FORT APPARATUS AND METHODS

(76) Inventor: Sean Mertes, Jordan, MN (US)

( * ) Notice: Subject to any disclaimer, the term of this patent is extended or adjusted under 35 U.S.C. 154(b) by 302 days.

(21) Appl. No.: 12/837,477

(22) Filed: Jul. 15, 2010

Related U.S. Application Data

(60) Provisional application No. 61/225,895, filed on Jul. 15, 2009.

(51) Int. Cl.
*A63H 33/08* (2006.01)

(52) U.S. Cl.
USPC ..... 446/111; 446/107; 446/124; 446/476

(58) Field of Classification Search
USPC ..... 52/656.9; 446/107–109, 111, 114, 116, 446/120–122, 124, 125, 127, 128, 476; 403/381, 348, 356, 373, 374.2, 374.5
See application file for complete search history.

(56) References Cited

U.S. PATENT DOCUMENTS

| | | | | |
|---|---|---|---|---|
| 294,589 | A | 3/1884 | Crandall | |
| 570,544 | A | 11/1896 | Flye | |
| D34,354 | S | 4/1901 | Miller | |
| 1,282,358 | A | 10/1918 | Arden | |
| 2,219,130 | A | 10/1940 | Herrmann | |
| 2,392,024 | A | 1/1946 | Cole | |
| 2,542,601 | A | 2/1951 | Cleef | |
| 2,556,323 | A | 6/1951 | Feigelman | |
| 2,693,809 | A | 11/1954 | Spencer | |
| 2,738,616 | A | 3/1956 | Windle | |
| 2,757,676 | A | 8/1956 | Hamilton | |
| 3,176,431 | A | 4/1965 | Richardson et al. | |
| 3,206,888 | A | 9/1965 | Franz | |
| 3,395,484 | A | 8/1968 | Smith | |
| 3,432,960 | A | 3/1969 | Bombaci | |
| 3,898,761 | A | 8/1975 | Zohar | |
| D245,640 | S | 8/1977 | Powell | |
| 4,505,687 | A | 3/1985 | Munro | |
| 4,540,006 | A | 9/1985 | Collis | |
| 4,648,414 | A | 3/1987 | Fox et al. | |
| 4,666,417 | A | 5/1987 | Hillman | |
| 4,764,143 | A * | 8/1988 | Gat et al. | 446/102 |
| 4,823,458 | A | 4/1989 | Hollenberg et al. | |
| 4,844,103 | A | 7/1989 | Vick et al. | |
| 5,144,968 | A | 9/1992 | Rivera | |

(Continued)

OTHER PUBLICATIONS

Bryan-College Station Girl Scouts Service Unit, Building Big With the Cranium Super Fort, Jun. 26, 2007, Z Recommendations, http://zrecs.blogspot.com/2007/06/build-big-with-cranium-super.fort.html, p. 1-8.*

(Continued)

*Primary Examiner* — Joshua J Michener
*Assistant Examiner* — Elizabeth A Plummer
(74) *Attorney, Agent, or Firm* — Albert W. Watkins

(57) ABSTRACT

A children's self-contained toy fort building apparatus has a malleable rod terminated at both ends with a connector. In one embodiment, the connectors couple directly with like connectors to form a multi-point connection with one or a plurality of rods. In a different embodiment, each rod is terminated with spuds, and a separate connector is provided which is operative to couple with and secure the spuds thereto. A method of constructing a structure such as a fort includes engaging a plurality of like longitudinally extensive elements together at terminations thereof, and forming at least one of said plurality of like longitudinally extensive elements into a non-linear shape.

4 Claims, 6 Drawing Sheets

(56) References Cited

U.S. PATENT DOCUMENTS

| | | | | | |
|---|---|---|---|---|---|
| 5,165,428 | A | | 11/1992 | Stohr | |
| 5,239,803 | A | * | 8/1993 | Shannon | 52/653.1 |
| 5,282,767 | A | * | 2/1994 | Gelardi | 446/126 |
| 5,372,152 | A | | 12/1994 | Dutch | |
| 5,498,190 | A | | 3/1996 | Ganson | |
| 5,647,181 | A | * | 7/1997 | Hunts | 52/282.1 |
| 5,769,994 | A | | 6/1998 | Booz et al. | |
| 5,839,248 | A | * | 11/1998 | Liang | 52/655.2 |
| 5,916,006 | A | | 6/1999 | Ganson | |
| 5,951,356 | A | * | 9/1999 | Cyrus et al. | 446/118 |
| 5,964,634 | A | | 10/1999 | Chang | |
| 5,975,977 | A | * | 11/1999 | Choi | 446/105 |
| 5,993,282 | A | | 11/1999 | Ernst | |
| 6,402,581 | B1 | | 6/2002 | Podgaiz | |
| 6,595,825 | B1 | * | 7/2003 | De Wilde | 446/102 |
| 6,644,292 | B1 | | 11/2003 | Ganson | |
| 6,783,420 | B2 | | 8/2004 | Nelson | |
| 6,952,905 | B2 | * | 10/2005 | Nickel et al. | 52/711 |
| 6,969,211 | B2 | * | 11/2005 | Altman | 403/374.4 |
| 7,316,598 | B1 | | 1/2008 | Lock et al. | |
| 7,364,487 | B2 | * | 4/2008 | Evans et al. | 446/108 |
| 7,827,940 | B2 | * | 11/2010 | Silverman | 119/474 |
| 8,109,803 | B2 | * | 2/2012 | Kichijo et al. | 446/109 |
| 2009/0093182 | A1 | * | 4/2009 | Jacobs et al. | 446/120 |
| 2009/0205997 | A1 | * | 8/2009 | Richards et al. | 206/579 |
| 2012/0055000 | A1 | * | 3/2012 | Poulsen | 29/428 |

OTHER PUBLICATIONS

Nelson, Afton, "Cranium Super Fort Will Give Your Couch Cushions a Break", Jun. 5, 2008, http://www.associatedcontent.com/article/203567/cranium_super_fort_will_give_your_couch.html, 1 page.

* cited by examiner

FIG. 8d
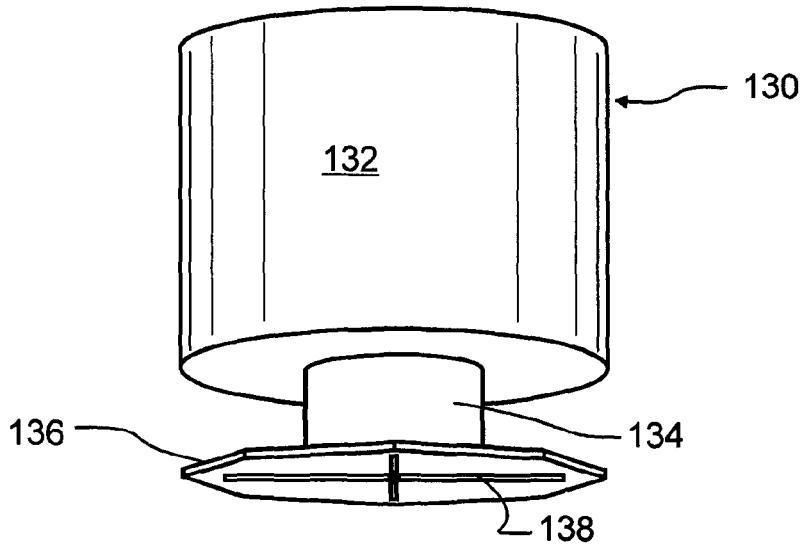
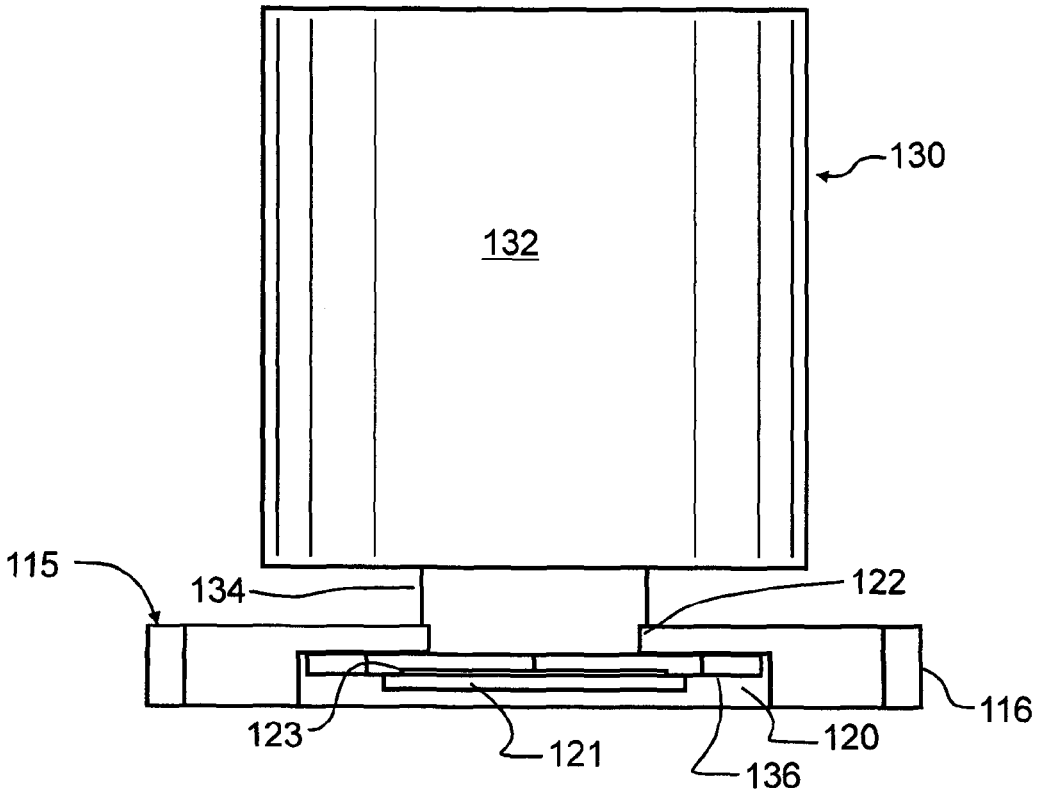
FIG. 8e

TOY FORT APPARATUS AND METHODS

CROSS REFERENCE TO RELATED APPLICATIONS

This application claims priority to co-pending U.S. provisional application Ser. No. 61/225,895 filed Jul. 15, 2009 of the same title, the contents of which are incorporated herein by reference in entirety.

BACKGROUND OF THE INVENTION

1. Field of the Invention

The present invention relates generally to amusement devices or toys, and more particularly to construction toys that comprise a plurality of parts for assembling, disassembling, or relatively arranging the parts. More particularly, the present invention pertains to cushioned, pliable building construction materials which may be connected to a plurality of such building construction materials to form more complex structures such as toy forts or buildings that may be constructed, occupied for play, learning, and imagination, and then later disassembled.

2. Description of the Related Art

Youth are imaginative in their play and interactions. A fort can be used for a shelter, a play house, a castle, a dog house, and much more. Forts of many varieties are found in prior art, including U.S. Pat. No. Des. 34,354 by Miller, entitled "Toy Fort"; U.S. Pat. No. Des. 245,640 by Powell, Jr., entitled "Toy Fort"; U.S. Pat. No. 294,589 by Crandall, entitled "Toy Building Block"; U.S. Pat. No. 570,544 by Flye, entitled "Toy or Game Device"; U.S. Pat. No. 1,282,358 by Arden, entitled "Toy Fort"; U.S. Pat. No. 2,556,323 by Feigelman, entitled "Folding Toy"; the contents of each which are incorporated herein by reference. These patents all provide sets for building a toy fort, but are intrinsically limited to one design, limiting the possibilities of use.

Customizable design is found in kits, such as U.S. Pat. No. 6,783,420 by Nelson, entitled "Building Toy Kit, Component Thereof, Method of Enhancing the Glow, Method of Packaging, and Package Thereof", the contents which are incorporated herein by reference. This patent describes a building material in which the materials are connected by stacking. A more complex, interlocking, method of stacking is shown using serpentine building elements in U.S. Pat. No. 3,898,761 by Zohar, entitled "Interlocking Construction Elements," the contents which are incorporated herein by reference.

Stacking is improved upon by providing a more secure method of attachment, as seen in patents such as U.S. Pat. No. 5,993,282 by Ernst, entitled "Toy Cube Set," the contents which are incorporated herein by reference. This patent describes a cube created with an interior and exterior wall, connected to other cubes with a peg that connects through holes, allowing for a vast assortment of possible arrangements. U.S. Pat. No. 5,964,634 by Chang, entitled "Soft Brick Modular Building Construction Set," the contents which are incorporated herein by reference, improves on this by offering a softer version made out of brick shaped foam blocks which connect together using Velcro™ brand or equivalent hook and loop strips on the fuzzy exteriors. The foam block construction increases the safety of the toy for all age groups.

An alternative is seen in U.S. Pat. No. 3,206,888 by Litzka, entitled "Deflectable Beam for Forming Curved Structures," the contents which are incorporated herein by reference, which illustrates plastic beams that can be secured in any number of locations, allowing for more freedom in determining the exact size and shape of a curved structure when building. However, the twists and turns are necessarily limited by the material, and the construction allows for damage to the set as well as the child if one were to accidentally fall into the structure.

Another method of construction is seen in U.S. Pat. No. 3,432,960 by Bombaci, entitled "Rods and Tubular Connectors Having Means for Limiting Rod Insertion," the contents which are incorporated herein by reference, which shows a method of construction using rods and connectors which accept a plurality of rods at various angles. Similarly, U.S. Pat. No. 7,316,598 by Lock, entitled "Toy Construction Set," the contents which are incorporated herein by reference, describes a building method comprised of tubes and a variety of connectors, allowing for different numbers of tubes to be connected at a variety of angles. A safer option is seen in U.S. Pat. No. 6,402,581 by Podgaiz, entitled "Building Toy," the contents which are incorporated herein by reference. This patent describes a flexible tubular building toy connected using fitted pegs that fit into the ends of the flexible tubular building unit as well as a connector unit. Undesirably, these patents each use multiple small pieces, which are readily lost.

The present invention seeks to provide an alternative which improves upon prior art by providing a cushioned, flexible building unit with a built in connector unit that allows for a plurality of connections at multiple angles.

Cushioned wire, enabling soft, customizable shaping is seen in early patents, such as U.S. Pat. No. 2,392,024 by Couri, entitled "Article of Manufacture," the contents which are incorporated herein by reference, which illustrates a material with a soft, pliable core and a cushioned outside, such as a rubber sponge sheath. Another approach is seen in U.S. Pat. No. 2,693,809 by Spencer, entitled "Hair Curler and Method of Treating Hair," the contents which are incorporated herein by reference, which illustrates a wrapped, padded wire curler for delivery of shine enhancing oils.

Foam embodied wire is often known for use with the hair as early as U.S. Pat. No. 2,542,601 by Cleef, entitled "Hair Curler," the contents which are incorporated herein by reference. This patent describes what may be the origins of the toy "tuber" technology, old hair curlers with foam and wire. Additional patents illustrate alternate embodiments and methods of manufacturing, as seen in U.S. Pat. No. 4,540,006 by Collis, entitled "Hair Roller"; U.S. Pat. No. 4,648,414 by Fox et al., entitled "Bendable Lightweight Article for Personal Grooming and Method of Making"; U.S. Pat. No. 4,823,458 by Hollenberg et al., entitled "Foam Bodied Hair Curler"; U.S. Pat. No. 4,844,103 by Vick et al., entitled "Bendable Permanent Wave Rod Apparatus"; U.S. Pat. No. 5,165,428 by Stohr, entitled "Deformable Foam Curler"; and U.S. Pat. No. 5,372,152 by Dutch, entitled "Hair Roller," the contents of each which are incorporated herein by reference.

U.S. Pat. No. 5,144,968 by Rivera, entitled "Permanent Wave Rod," the contents which are incorporated herein by reference, is not only a cushioned, shapeable article for use in the hair, it provides fibers on the ends to engage each other, holding the wave rod engaged. U.S. Pat. No. 2,757,676 by Hamilton, entitled "Hair Curling Assembly," the contents which are incorporated herein by reference, attempts a similar thing by having a strap to secure one end of the curler to the other, holding the hair engaged.

The flexible, form-retaining material in toys has a long history as well, including U.S. Pat. No. 4,505,687 by Munro, entitled "Form Retaining Stuffed Figurine," the contents which are incorporated herein by reference, which can be stretched and will spring back to its original form. U.S. Pat. No. 3,176,431 by Richardson et al, entitled "Resilient Action Figure Toy," the contents which are incorporated herein by reference, allows for stretching and compressing on all planes, making it more interesting and entertaining for youth. However, such devices lack the options for creativity and diverse uses found in U.S. Pat. No. 2,219,130 by Herrmann, entitled "Toy and Display Figure," the contents which are incorporated herein by reference, which allows the user to readily configure the position of the figure of a gumby-esque wire core flexible toy. U.S. Pat. No. 3,395,484 by Smith, entitled "Doll Figures Having an Internal Wire Skeleton," the contents which are incorporated herein by reference, illustrates an alternative flexible core toy. Similarly, U.S. Pat. No. 4,666,417 by Hillman, entitled "Flexible Tubular Toy," the contents which are incorporated herein by reference, is a cushioned wire which allows the user to alterably configure the shape.

Even more user creativity and choice is found in U.S. Pat. No. 2,738,616 by Windle, entitled "Tube toy," the contents which are incorporated herein by reference. This patent describes liquid filled tubes which can be manipulated, twisted, or knotted during play. This design does not readily hold all manipulations, however. U.S. Pat. No. 5,498,190, entitled "Flexible Foam Construction Toy and Method of Manufacturing Same," and U.S. Pat. No. 5,916,006, entitled "Flexible Foam Construction Set," both by Ganson, the contents of each which are incorporated herein by reference, illustrate a foam construction set which allows for shaping and twisting of the flexible toy pieces. Connections and building using the foam construction toy is done through twisting together and/or around other units, or passing the variously sized and shaped components through holes in certain units. These, too, lack a connector which can solidly hold in place, regardless of rough play which can happen in instances where the fort is "under attack."

Webster's New Universal Unabridged Dictionary, Second Edition copyright 1983, is additionally incorporated herein by reference in entirety for the definitions of words and terms used herein.

SUMMARY OF THE INVENTION

In a first manifestation, the invention is a children's fort building apparatus. The apparatus has a malleable longitudinally extensive member; and a connector terminating the malleable longitudinally extensive member at a first end.

In a second manifestation, the invention is a children's building toy, comprising a plurality of longitudinally extensive structural members each terminated with spuds; and a connector operative to couple with said spuds and secure said spuds thereto.

In a third manifestation, the invention is a method of constructing a structure. According to the method, a plurality of like longitudinally extensive elements are engaged at terminations thereof. At least one of said plurality of like longitudinally extensive elements is then formed into a non-linear shape.

OBJECTS OF THE INVENTION

Exemplary embodiments of the present invention solve inadequacies of the prior art by providing a cushioned, flexible building unit with a built in connector unit that allows for a plurality of connections at multiple angles which can be used to create virtually any construction. In different embodiments, the connector may be complete, meaning it may couple directly with other like connectors, or the connector may couple to a connector box.

A first object of the invention is to provide a construction unit which is lightweight and cushioned for easy and safe use. A second object of the invention is to provide a construction unit which can be directly interconnected without any additional pieces or connectors. Another object of the present invention is to provide a construction unit which can be bent, twisted, or otherwise shaped into virtually any desirable shape. A further object of the invention is to reduce or eliminate small parts that may be potentially harmful or lost. Yet another object of the present invention is to provide intuitive and easily assembled construction units that may readily be assembled without instruction by users of nearly all age.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which:

FIGS. 8*a*-8*d* illustrate the components of the second preferred embodiment, while FIG. 8*e* illustrates a single connector pair from enlarged view.

DESCRIPTION OF THE PREFERRED EMBODIMENT

Manifested in the preferred embodiment, the present invention provides a children's building apparatus 1 comprised of a soft, pliable bar 5 with multi-faceted connectors 10 on either end. Most preferably, bar 5 is a malleable material such as, but not limited to, malleable metal wire coated with a soft covering. The wire will desirably be sufficiently malleable to allow for shaping during play. In this preferred embodiment aluminum wire has been used, though other metals and other materials will be understood to be suitable as well. Most preferably, this material is sufficiently rigid to support sheets and blankets, while still being sufficiently malleable to permit a child to bend the wire into desired shapes. To enhance feel, safety, and utility, preferred embodiment bar 5 further includes a soft covering or cushion such as, but not limited to foam. Connectors 10 are multi-faceted, allowing a plurality of like apparatus 1 to be interconnected to each other at different angles, lending children's building apparatus 1 to be formed into a variety of structures where size and shape are only limited by the quantity of children's building apparatus 1 available.

Figure 1:
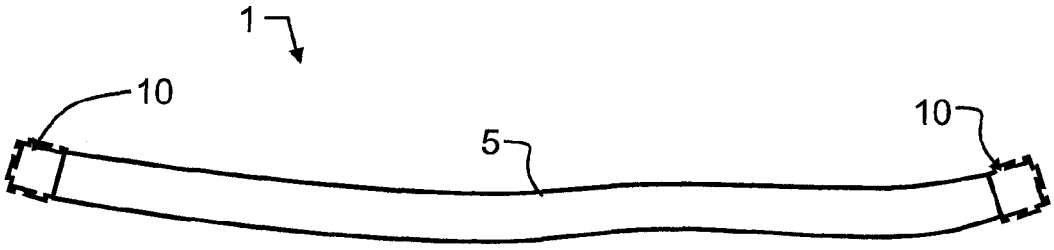
FIG. 1 illustrates a first preferred embodiment of the invention from front plan view.
Figure 2:
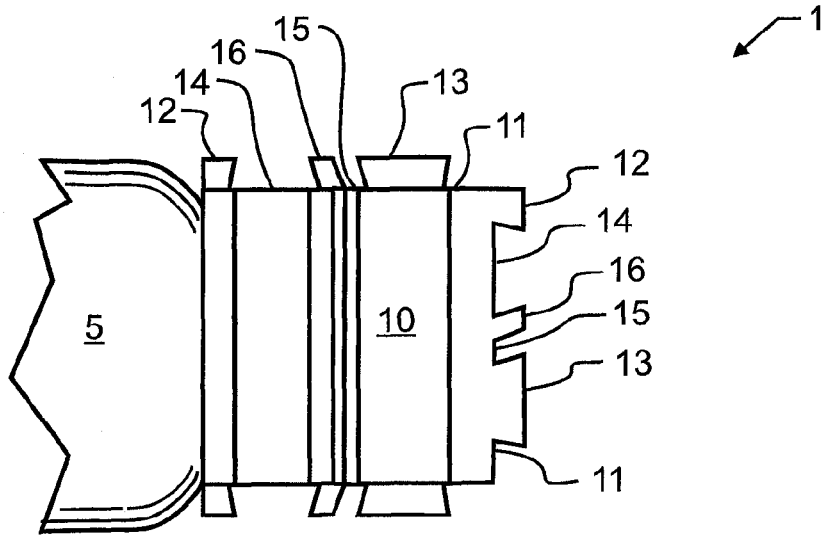
FIG. 2 illustrates a first preferred embodiment connector end used in the first preferred embodiment of the invention from front view.

FIG. 2 illustrates preferred embodiment multi-faceted connector 10 in more detail. While any number of alternative designs are possible and included herein by reference, preferred embodiment multi-faceted connector 10 is a six-sided cube with grooves 11, 14, 15 and ridges 12, 13, 16 on five sides. The sixth side is attached to bar 5 in any number of ways, including, but not limited to a piece bound to the wire inside bar 5 that would bite into the inside of multi-faceted connector 10, or other suitable connection through means such as a loop, or adhesives known to those skilled in the art, including but not limited to glue.

Figure 3:
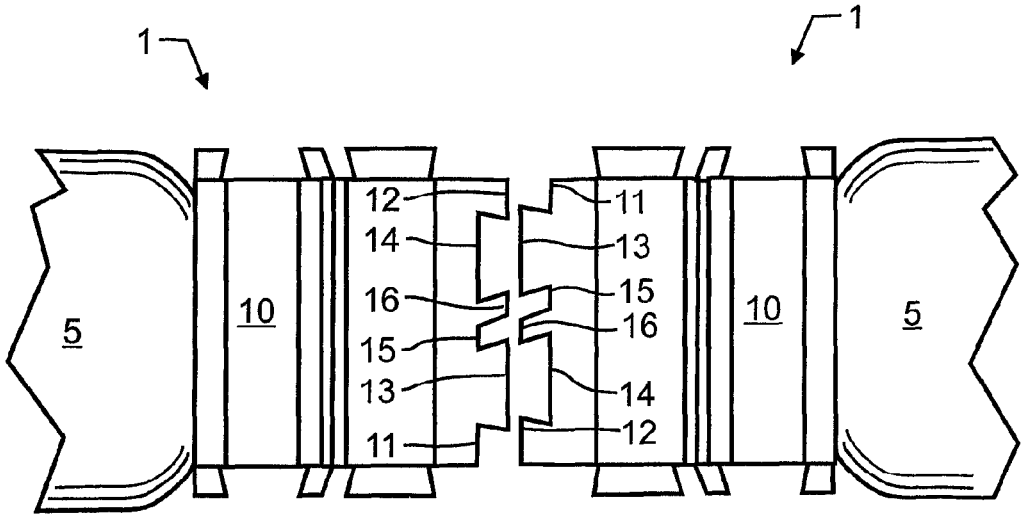
FIG. 3 illustrates combinations of the first preferred embodiment connector ends from disassembled view.
Figure 4:
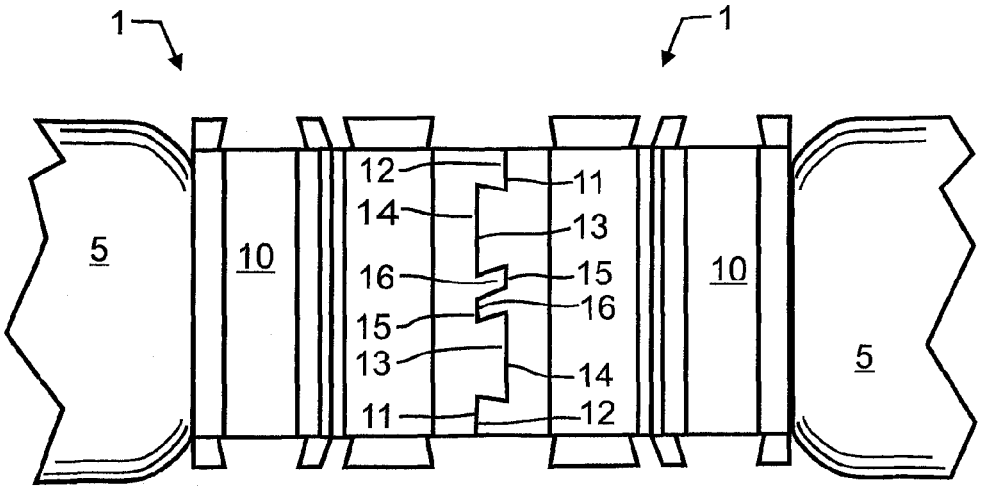
FIGS. 4 and 5 illustrate the combinations of the preferred embodiment connector ends illustrated in FIG. 3 from assembled view.
Figure 5:
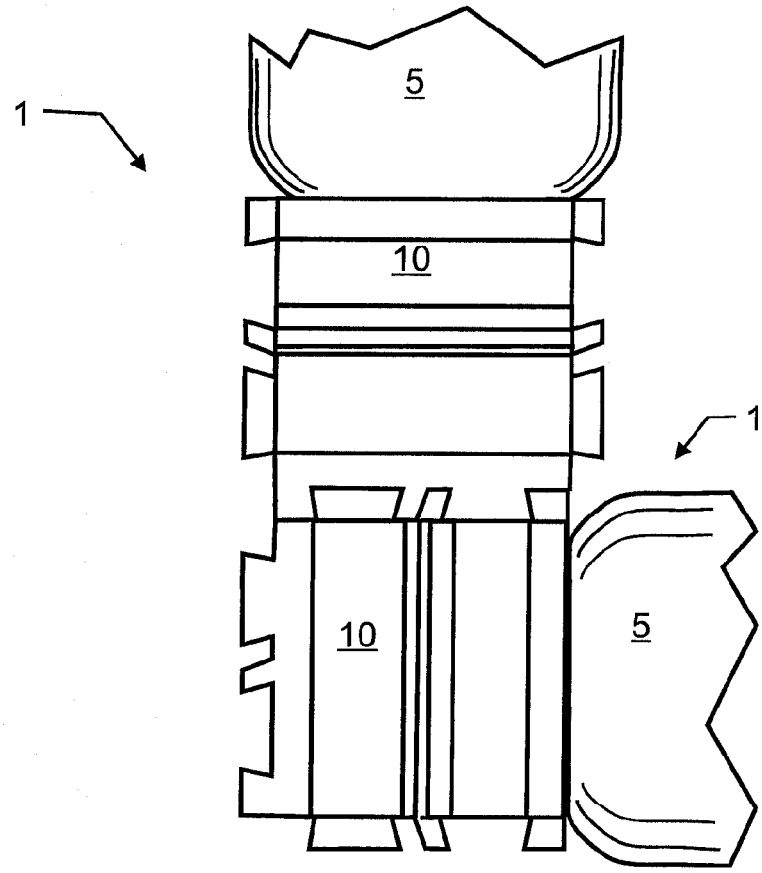

As can be seen in FIGS. 3-5, multi-faceted connectors 10 are designed to lock into place together by interlocking the grooves 11, 14, 15 and ridges, 12, 13, 16. In the most preferred embodiment, ridge 12 interlocks with groove 11, ridge 13 interlocks with groove 14, and ridge 16 interlocks with groove 15. Furthermore, ridges 12, 13 are most preferably tapered out to form dovetails which, when engaged with grooves 11, 14, improves the durability of the connection between multi-faceted connectors 10. Another feature of preferred embodiment multi-faceted connectors 10 is that any of the five grooved faces can be used to connect to another multi-faceted connector 10. As a result, any one multi-faceted connector 10 can connect to as many as five other multi-faceted connectors. Additionally, in constructing a structure, children's building rods 1 can connect together from a variety of directions.

Figure 6:
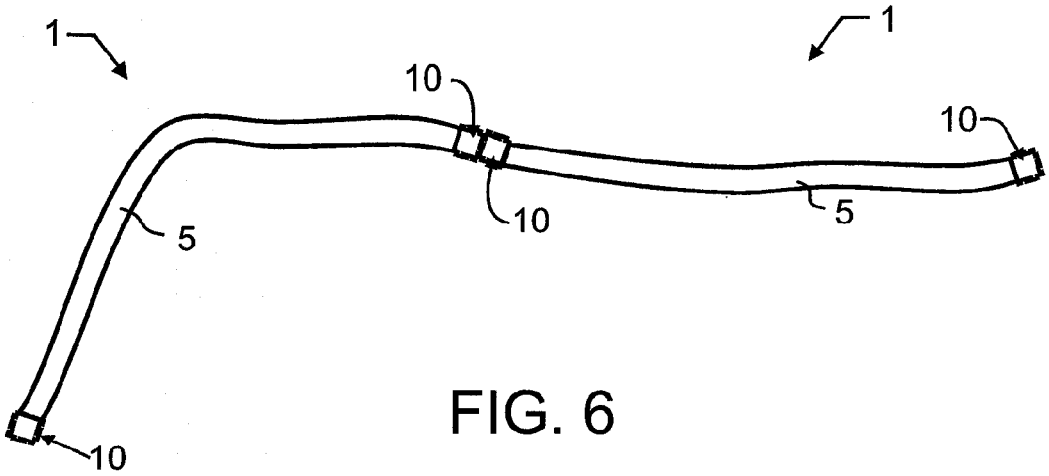
FIG. 6 illustrates the further combination of the first preferred embodiment of the invention as illustrated in FIG. 1 with a like component.

Finally, FIG. 6 shows two children's building rods 1 connected together. As can be seen in the illustration, bar 5 can be arced or kept relatively straight to create the structural form desired. Upon the completion of the structural frame, a child or other person will have the option of adding sheets, blankets, pillows, or other common household materials to create walls around the frame. Additionally, the structure is light weight, and so can be readily moved. Alternatively, a resulting structure may be easily disassembled for clean-up. The light weight of the individual components is beneficial with regard to safety, since a less massive component is also less likely to cause harm, even when misused.

The children's building apparatus 1 is fully self-contained, meaning there are no other apparatus required to build a fort or other structure, other than any coverings that a person may choose to apply. A variety of building methods may be applied to children's building apparatus 1, the combinations which will have many benefits associated therewith. As noted, soft, cushioned bar 5 will most preferably be easily molded during play to form any variety of contours, which may then be used to form an endless variety of structures which are only limited by a person's imagination, including but not limited to forts, tunnels, and other play structures of children's choosing.

Figure 7:
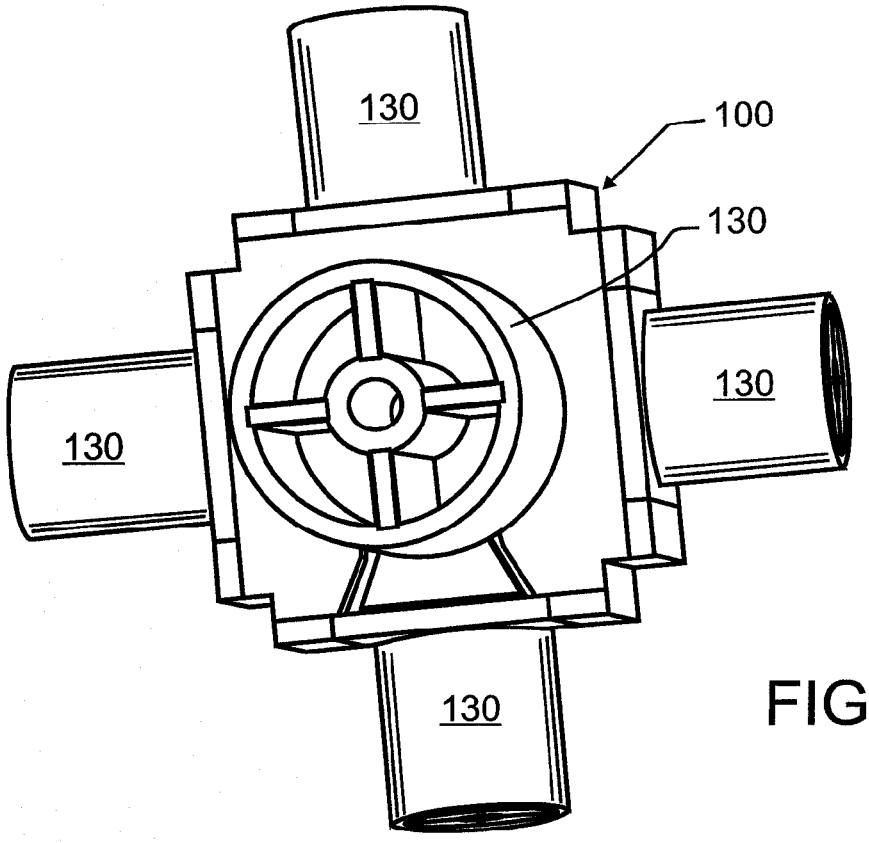
FIG. 7 illustrates a second preferred embodiment connection, with only connector components illustrated.
Figure 8A:
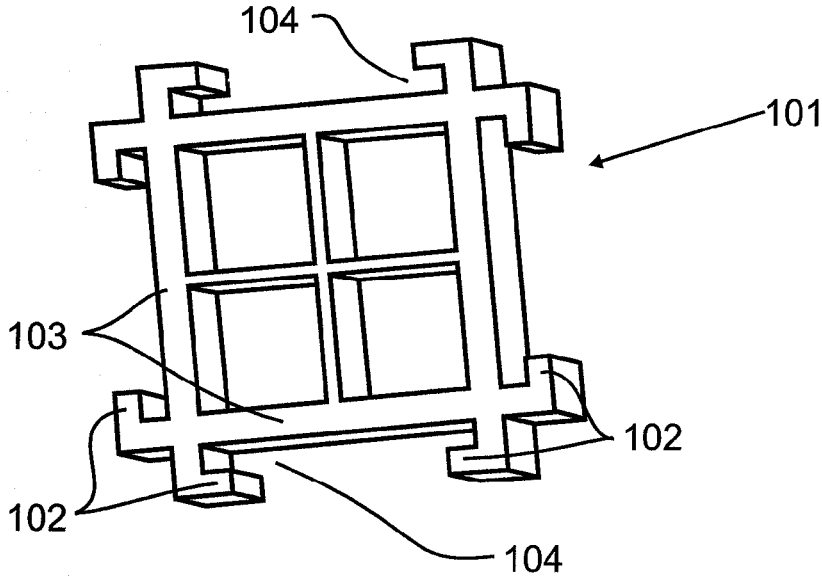
Figure 8B:
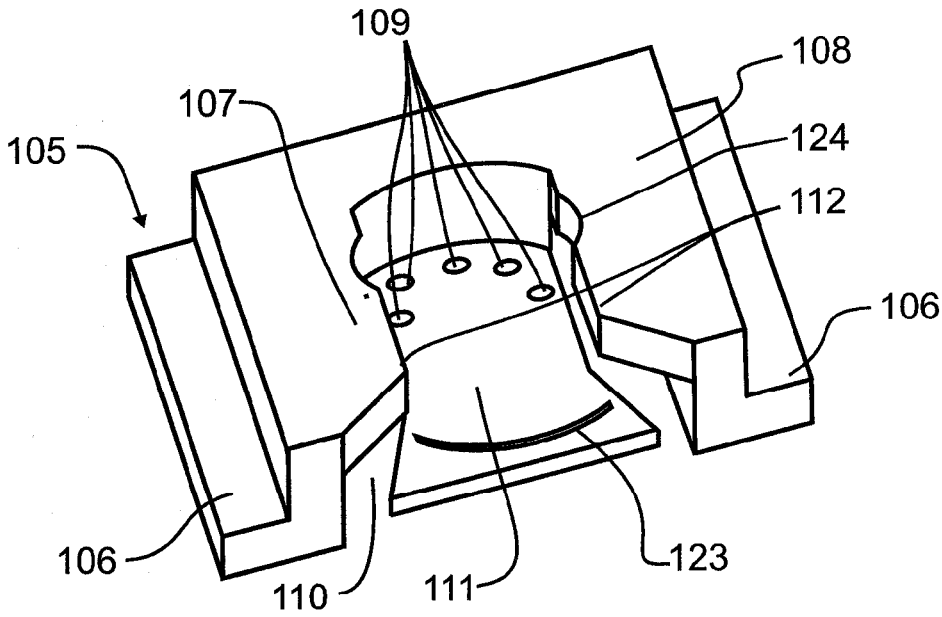
Figure 8C:
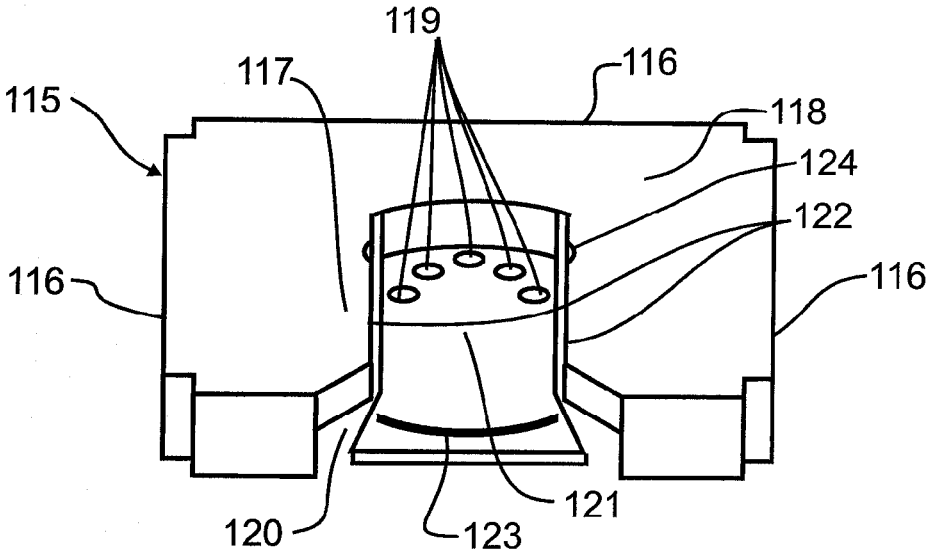

A second preferred embodiment connector box 100 is illustrated in FIG. 7, operatively coupled with a plurality of spuds 130. In this second embodiment, cushioned wire bar 5 has a spud 130 attached to both ends. Spuds 130 then engage with connector box 100. When more than one spud 130 engages with connector box 100, a connection is formed between the spuds, and consequently between the corresponding bars 5. In such a system, as many as six spuds 130 may engage with connector box 100 in a secure manner. While this second embodiment connector box 100 requires both a plurality of cushioned wire bars 5 each terminated with spuds 130 and at least one separate connector box 100, meaning there are at least two distinct apparatus required to construct a structure, the second preferred embodiment benefits from less mass and smoother geometries at each termination of wire 5, and also from simpler and more rapid assembly and disassembly, as will become more apparent from the following description.

As can be seen in FIGS. 8*a*-8*e*, second preferred embodiment connector box 130 is comprised of a frame 101, side clips 105, top and bottom plates 115, and spuds 130. Most preferably, frame 101 is comprised of four sides 103 which give it a cube shape. Each side 103 has two right angles protruding out from the corners to form guides 102. Guides 102 face toward the center of each side 103 in such a manner that a square object can slide into the gap 104 formed by side 103 and guides 102 and will thereby be reasonably held in place. In this second preferred embodiment, four side plates 105 then engage with frame 101 by sliding into gap 104 and are then further held into place by plates 115 which are welded, adhered, or otherwise connected to the top and bottom of frame 101. Each side plate 105 has wings 106 for the purpose of sliding in between sides 103 and guides 102, whereas each plate 115 has extended sides 116 for the purpose of covering the ends of side plates 105 and, therefore, holding side plates 105 in place once plates 115 are connected to frame 101.

In this second preferred embodiment, all plates 105, 115 have a slot 110, 120 to engage spud 130. The slot 110, 120 is formed by having a raised surface 108, 118 with an opening formed by tabs 112, 122. Each slot 110, 120 has a resilient member 111, 121 which protrudes at a slight angle into the bottom of slot 110, 120. Resilient member 111, 121 has raised grips 109, 119 for interaction with spud 130.

Most preferably, spud 130 has a base 132 from which neck 134 extends and bells out into engaging member 136. In this preferred embodiment, engaging member 136 is octagonal, though it is contemplated herein to construct this member with any number of sides, as will be discussed further herein below. Engaging member 136 has the additional feature of a protruding grip 138. Protruding grip 138 can be any variety of shapes, including, but not limited hereto, a cross, zig-zags, bumps, straight lines, and the like, and may further comprise either protrusions, indentations, or some combination thereof. In the present embodiment, protruding grip 138 is contemplated as a cross. In the actual engagement between spud 130 and plates 105, 115, engaging member 136 slides into slot 110, 120. As engaging member 136 slides into place, it would most preferably apply pressure to resilient member 111, 121, which in turn would apply pressure to engaging member 136, holding it into place against raised surface 108, 118. Additionally, protruding grip 138 would click into place with raised grips 109, 119 in such a manner that arms of the cross shape would engage with raised grips 109, 119 and prevent sliding and limit rotation.

Furthermore, in the process of sliding spud 130 into slot 110, 120, neck 134 slides through the gap between tabs 112, 122. Most preferably, the gap between tabs 112, 122 is smaller than the diameter of neck 134, requiring tabs 112, 122 to flex to allow the passage of neck 134 therebetween. This configuration provides an additional catch to hold spud 130 in place.

When a fort or other toy structure is assembled from the foregoing components, it is generally desirable that the components hold the shape formed by the builder, and not sag, droop or bend out of shape without a reasonably large force to cause such change. In order to prevent unintended shape changes, it is desirable that spud 130 will not accidentally rotate within slot 110, 120. This is accomplished in several ways herein, though not limited solely thereto. First, protruding grip 138 preferably clicks into place with raised grips 109, 119, and any rotation therebetween causes tab 112, 122 to flex and snap, providing positive rotational holding. In addition, and with proper design, engaging member 136 may be provided with a plurality of flat sides, such as illustrated in FIG. 8*d*. If the dimension of slots 110, 120 is close to the diameter of engaging member 136, such that the space therebetween is minimal, then as the junction between flats is rotated, it will engage with the side walls of the slots and inhibit free rotation. With proper materials and dimensions, it is possible to provide a coupling having a large number of possible rotational orientations, that will hold in desired rotational orientation when assembled. With flexible materials, the slot may be designed to expand when force is applied to rotate engaging member 136, allowing an intentional rotational adjustment to be made.

The geometry of tabs 112, 122 as illustrated is from top view in the general form of a keyhole, where 124 identifies an enlarged receiver region where the spud neck 134 will operatively rest.

While fabrication from resilient materials will ordinarily be sufficient to provide necessary resilience, such as when plastic is used as the material, it is further contemplated herein to provide additional resiliency when desired. To this end, tabs 112, 122 have increased resiliency provided by either thinning the material, providing openings, or providing a material of increased resiliency in region 107, 117.

From these figures, several additional features and options become more apparent. First of all, children's building apparatus 1 in either embodiment and in accord with the present invention may be manufactured from a variety of materials, including metals, plastics or other resins, ceramics and cementitious materials, and composites, alloys, laminates, or even combinations of the above. The specific material used may vary, though special benefits are attainable if several important factors are taken into consideration. Firstly, the children's building apparatus 1 should be sufficiently light to enable even a relatively young child to be able to readily manipulate and adjust the toy. It is also preferable that children's building apparatus 1 be sufficiently cushioned to prevent injuries in the case of collision with an individual. Furthermore, it is preferable that bar 5 be sufficiently malleable to enable easy adjustment but rigid enough to maintain the contours it is shaped into. Additionally, it is preferable that connector 10 is rigid enough to prevent interlocking grooves 11, 14, 15 and ridges, 12, 13, 16 from slipping apart unintentionally. Most preferably, children's building apparatus 1 will also be sufficiently durable and water resistant to withstand wear and tear from regular use, collision with other objects, and accidental spills.

The actual engagement between connectors 10 is dependent somewhat upon the materials. The most preferred materials for connectors 10 are plastics, which may or may not include various reinforcing fibers or particles, and other ingredients known to enhance the properties of the composition and resulting product. The plastics may be modified to have adequate resistance to environment, and are accompanied by low cost and ready manufacture to custom geometries.

A variety of designs have been contemplated for connectors 10, 100, including any number of and suitable geometries for grooves 11, 14, 15 and ridges, 12, 13, 16, and the similar interconnecting structures found in connectors 100.

Further contemplated herein is the incorporation of additional components into plates 105, 115. For exemplary purposes only, and not limited thereto, a rubber pad or Velcro™ brand or equivalent hook pad could be affixed to a plate 105, 115 distal to slot 110, 120 and spud 130. This modified plate would be provided separate from connector box 100, and so could be affixed to a spud and then, for exemplary purposes, anchored to the floor through the rubber pad, such as a for a hard or wood floor, or to carpet using the hook pad. Many other materials could be similarly affixed, including temporary or permanent adhesives such as double sided tape when it might be desirable to affix to a wall, ceiling or other object. Furthermore, other objects may be provided within on or more plates about connector box 100, and can be incorporated with or provided instead of couplings for spuds 130. One example is the incorporation of an LED light with power source and switch into connector box 100, such that instead of six spud connection locations, there could optionally be one light and five connections, again for exemplary purposes.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. A children's fort building apparatus, comprising:

a malleable longitudinally extensive member;

a spud having a connector terminating said malleable longitudinally extensive member at a malleable longitudinally extensive member first end, and having a base from which a neck having a smaller diameter than said base extends along a longitudinal axis and bells out into an enlarged engaging member;

a connector box having at least one plate, said at least one plate having at least one slot open entirely through a thickness of said at least one plate and extending from an edge terminus of said at least one plate to an interior, said at least one slot operatively receiving said neck and said engaging member, and said at least one plate operatively engaging with said engaging member and said base to prevent longitudinal motion of said spud relative to said at least one plate when said neck is operatively received within said at least one slot, said at least one plate having opposed tabs protruding into said at least one slot adjacent a first plate surface and defining a gap smaller than the diameter of said neck and smaller than said at least one slot distal from said first plate surface, said opposed tabs capable of operative flexure to permit said neck to operatively pass through said gap and thereby slide from said edge of said at least one plate to said interior of said at least one plate; and a plurality of flat sides on said engaging member operative to engage said at least one plate when said engaging member is operatively located within said at least one slot and said engaging member neck passes through said thickness of said at least one plate, with an operative engagement between said at least one plate and said plurality of flat sides of said engaging member operative to inhibit free rotation there between about said longitudinal axis and thereby operatively inhibit free rotation of said malleable longitudinally extensive member relative to said connector box when said engaging member is operatively located within said at least one slot;

said at least one slot expansible when intentional force is applied to operatively disengage said plurality of flat sides on said engaging member from said at least one plate to permit rotation there between and thereby operatively intentionally rotate said malleable longitudinally extensive member about said longitudinal axis of said malleable longitudinally extensive member relative to said connector box while said neck remains within said at least one slot and passes through said thickness of said at least one plate;

said neck operatively passing with restriction through said gap between said opposed tabs into an enlarged region between said opposed tabs as said engaging member is slid into said at least one slot, said neck thereby operatively constrained within said enlarged region between said opposed tabs when said engaging member is slid into said at least one slot.

2. The children's fort building apparatus of claim 1, wherein said at least one slot further comprises a plurality of slots.

3. A children's fort building apparatus, comprising:

a malleable longitudinally extensive member;

a spud terminating said malleable longitudinally extensive member at a first end and having a base rigidly coupled to said longitudinally extensive member a neck extending from said base; and an engaging member distal on said neck from said malleable longitudinally extensive member, said base, neck and engaging member defining a longitudinal axis, said neck having a smaller diameter about said longitudinal axis than a diameter about said longitudinal axis of either of said first end and said engaging member;

a connector box having a plate, the plate having a slot operatively removably receiving said neck and engaging member and having a raised surface and opposed tabs; and a plurality of side junctions on said engaging member operative to engage said plate within said slot while said neck and engaging member are received therein to inhibit free rotation there between and thereby operatively inhibit free rotation of said malleable longitudinally extensive member relative to said connector box;

said slot expansible when intentional rotary force about said longitudinal axis is applied to operatively disengage said plurality of side junctions on said engaging member from said plate to permit rotation there between while still retaining said neck and said engaging member within said slot and thereby operatively rotate said malleable longitudinally extensive member relative to said connector box.

4. The children's fort building apparatus of claim 3, wherein said opposed tabs are resilient, said neck operatively passing with restriction through a narrowed region between said opposed tabs, by flexing said opposed tabs, and into an enlarged region between said opposed tabs as said engaging member is slid into said slot, said neck thereby operatively constrained within said enlarged region between said opposed tabs when said engaging member is slid into said slot.

* * * * *